US008283998B2

(12) United States Patent
Rosenberg et al.

(10) Patent No.: US 8,283,998 B2
(45) Date of Patent: Oct. 9, 2012

(54) ANTENNA FEED DEVICE

(75) Inventors: Uwe Rosenberg, Backnang (DE); Ulrich Mahr, Backnang (DE); Jurgen Ebinger, Aspach (DE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 891 days.

(21) Appl. No.: 12/162,385

(22) PCT Filed: Feb. 1, 2007

(86) PCT No.: PCT/EP2007/050972

§ 371 (c)(1), (2), (4) Date: Jan. 19, 2009

(87) PCT Pub. No.: WO2007/088184

PCT Pub. Date: Aug. 9, 2007

(65) Prior Publication Data

US 2010/0066463 A1 Mar. 18, 2010

(30) Foreign Application Priority Data

Feb. 3, 2006 (GB) ..... 0602186.9

(51) Int. Cl.
*H01P 1/161* (2006.01)

(52) U.S. Cl. ..... 333/137; 333/21 A; 343/776

(58) Field of Classification Search ..... 333/125, 333/137, 218, 254, 21 A; 343/772, 776
See application file for complete search history.

(56) References Cited

U.S. PATENT DOCUMENTS 3,731,236 A * 5/1973 Di Tullio et al. ..... 333/126
5,578,972 A 11/1996 Hadden et al.
5,600,336 A * 2/1997 Kubo et al. ..... 343/756
6,225,875 B1 * 5/2001 Kich ..... 333/125
7,019,603 B2 * 3/2006 Yoneda et al. ..... 333/125

FOREIGN PATENT DOCUMENTS

| | | | |
|---|---|---|---|
| DE | 3607846 | A1 | 9/1987 |
| EP | 0809319 | A1 | 11/1997 |
| EP | 1191624 | A2 | 3/2002 |
| EP | 1341258 | A1 | 9/2003 |
| GB | 2130443 | A | 5/1984 |

OTHER PUBLICATIONS

Raisanes, A. V. et al. "A Novel Split-Waveguide Mount Design for Millimeter- and Submillimeter-Wave Frequency Multipliers and Harmonic Mixers." IEEE Microwave and Guided Wave Letters, vol. 3, No. 10, Oct. 1993, pp. 369-371.

* cited by examiner

*Primary Examiner* — Benny Lee
*Assistant Examiner* — Gerald Stevens
(74) *Attorney, Agent, or Firm* — Coats & Bennett, P.L.L.C.

(57) ABSTRACT

An antenna feed device (100) having a first waveguide (102) and a second waveguide (104) separated from the first waveguide (102), each of which is assigned to feed one polarization of a dedicated antenna and each of said waveguides exhibit an overall L-shape form where at least one section of the L-shape of each waveguide is in parallel to the other, both having respectively a first (106) and a second (108) antenna end ending in one plane for connection to an ortho-mode transducer associated with the antenna, while the other sections of the two L-shape waveguides extend in opposite directions, having respectively a first (110) and a second (112) radio end, each of which ends with a single waveguide port for connection to a radio equipment and the waveguides arrangement yields an overall compact T-shape interconnection of the antenna and the radios dedicated to the orthogonal polarizations.

8 Claims, 3 Drawing Sheets

ANTENNA FEED DEVICE

FIELD OF THE INVENTION

The present invention relates in general to the field of waveguide devices and in particular to the field of devices for direct feeding of an antenna.

BACKGROUND OF THE INVENTION

Commonly, a single radio is used for direct feeding of an antenna without the need of additional mounting and waveguide interconnecting elements. In this type of solution, the radio is directly supported at the antenna and its waveguide interface directly fits the antenna interface that serves the assigned polarization. The increase of link capacity can be obtained by polarization reuse, i.e., the transmission of a second channel with orthogonal polarization.

One solution of this type known in the art is the complete installation of a radio direct feeding antenna as used for the first channel. The drawback of this solution is that it is expensive due to the occupied space on the site. Quite often the space available at the sites is limited and therefore only a certain number of antennas can be installed to serve a dedicated link direction.

Another solution uses a common antenna serving both polarizations. Owing to the required access to the waveguide interfaces for both polarizations of state-of-the-art antennas, a direct feeding of the antenna with the two radios serving the orthogonal polarizations is no longer possible. Hence, the radios are separately mounted as close as possible to the antenna and the interconnection of radio and antenna RF interfaces is made by additional waveguide hardware as e.g. flexible waveguides. The separate mounting of the radios needs also a certain space close to the antenna and the additional waveguides will increase the insertion loss and therefore impair the link performance. Moreover, the separate mounting and waveguide hardware increases the cost of the solution.

Hence, an improved device for direct feeding orthogonal polarized waves of an antenna would be advantageous and in particular one that has good performance characteristics, compact size and is easy for manufacturing.

SUMMARY OF THE INVENTION

Accordingly, the invention seeks to preferably mitigate, alleviate or eliminate one or more of the disadvantages mentioned above singly or in any combination.

According to the present invention there is provided an antenna feed device having a first waveguide and a second waveguide separated from the first waveguide. Each of these waveguides is assigned to feed one polarization of a dedicated antenna and each of said waveguides exhibit substantially an overall L-shape form. At least one section of the L-shape of each waveguide is in parallel to the other, both having respectively a first and a second antenna end ending in one plane for connection to an ortho-mode transducer associated with the antenna, while the other sections of the two L-shaped waveguides extend in opposite directions, having respectively a first and a second radio end. Each of these radio ends end with a single waveguide port for connection to a radio equipment. The waveguides arrangement yields substantially a compact T-shape interconnection of the antenna and the radios dedicated to the orthogonal polarizations.

Further features of the present inventions are as claimed in the dependent claims.

The benefit of the present invention is that it provides a compact solution for the operation of two orthogonal polarized channels of a link by a single antenna. It allows for cost savings since extra hardware for installation and mounting of the radios as well as for the RF waveguide interconnections is not required. Moreover, the area at the site will not be overcrowded with equipment and antennas, which is important from the point of view of maintenance. In addition, there is no remarkable insertion loss increase, i.e., the link performance of each radio is comparable to that of an integrated single radio solution. The invention can be used to upgrade the state-of-the-art solution with one radio feeding directly an assigned polarization of an antenna.

BRIEF DESCRIPTION OF THE DRAWINGS

The present invention will be understood and appreciated more fully from the following detailed description taken in conjunction with the drawings in which.

DESCRIPTION OF AN EMBODIMENT OF THE INVENTION

Figure 1:
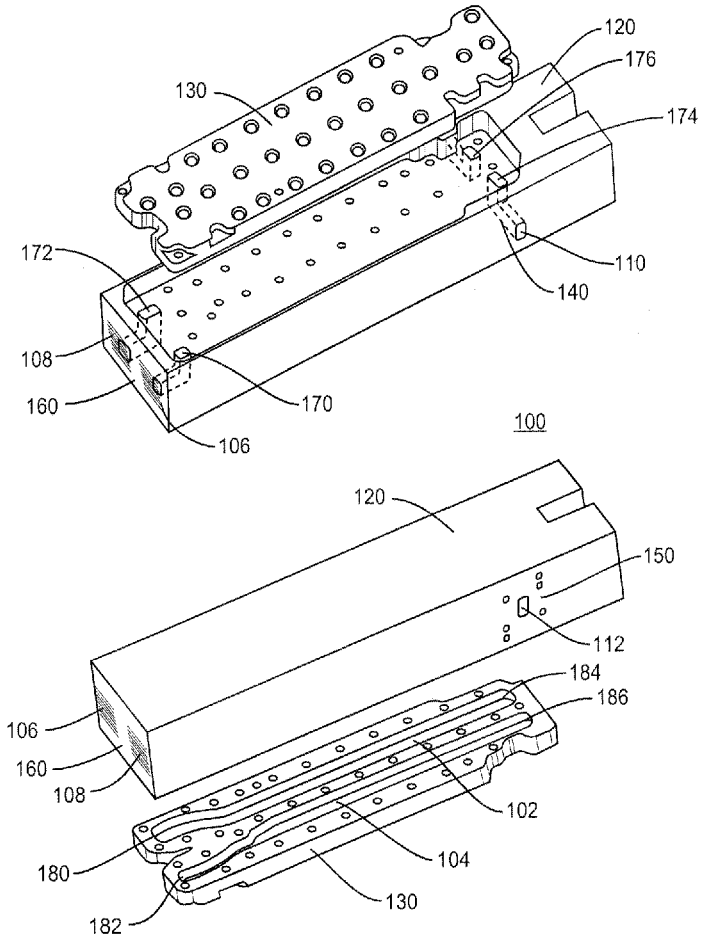
FIG. 1 is an antenna feed device in accordance with one embodiment of the present invention.

With reference to FIG. 1, an antenna feed device 100 in accordance with one embodiment of the present invention is presented. The antenna feed device 100 has a base part 120 and a cover part 130 detachably connected by bolts or in another suitable way. The cover part 130 comprises three walls of a first rectangular waveguide 102 and the three walls are form a rectangular groove milled in the cover part 130. The cover part 130 also comprises three walls of the second rectangular waveguide 104 formed in the same way as those of the first waveguide 102. The longer symmetry axes of cross-sections of the rectangular waveguides 102, 104 are orthogonal. The two waveguides are terminated with four 90-degree bends 180, 182, 184, 186 for directing the propagated signals in directions perpendicular to the main plane of the cover part 130. The base part 120 comprises a first waveguide interface 140 for connecting a first radio unit to the first rectangular waveguide 102 and a second waveguide interface 150 for connecting a second radio unit to the second rectangular waveguide 104. The two interfaces 140 and 150 for connecting radios are placed on opposite sides of the base part 120. The base part also comprises a third waveguide interface 160 for connecting to the two rectangular waveguides 102, 104 an ortho-mode transducer.

Ortho-mode transducer (OMT) is a device forming part of an antenna feed, which is used to combine or separate orthogonally polarized signals. In practice it is a three port waveguide device, where two of these ports are for transmitting signals dedicated to the orthogonal orientations. These two ports are connected to the third waveguide interface 160. The third port of the OMT is for connecting a waveguide for transmitting combination of the two orthogonally polarized signals.

The base part 120 also comprises four 90-degree bends 170-176 for connecting ends of the two rectangular waveguides 102, 104 milled in the cover part 130 to respective inputs/outputs of the three interfaces 140, 150, 160. The bends 170, 172, 174, 176 in the base part 120 are connected to the bends 180, 182, 184, 186 in the cover part 130 and the fourth walls close the first 102 and second 104 waveguides when the base part 120 is mounted to the cover part 130.

In one embodiment of the present invention at least one of the 90-degree bends 170, 172, 174, 176 and 180, 182, 184, 186 is a stepped band. It is possible that in a preferred embodiment, due to good performance characteristics and easy manufacturing all of these bends 170, 172, 174, 176 and 180, 182, 184, 186 are stepped bands.

Figure 3:
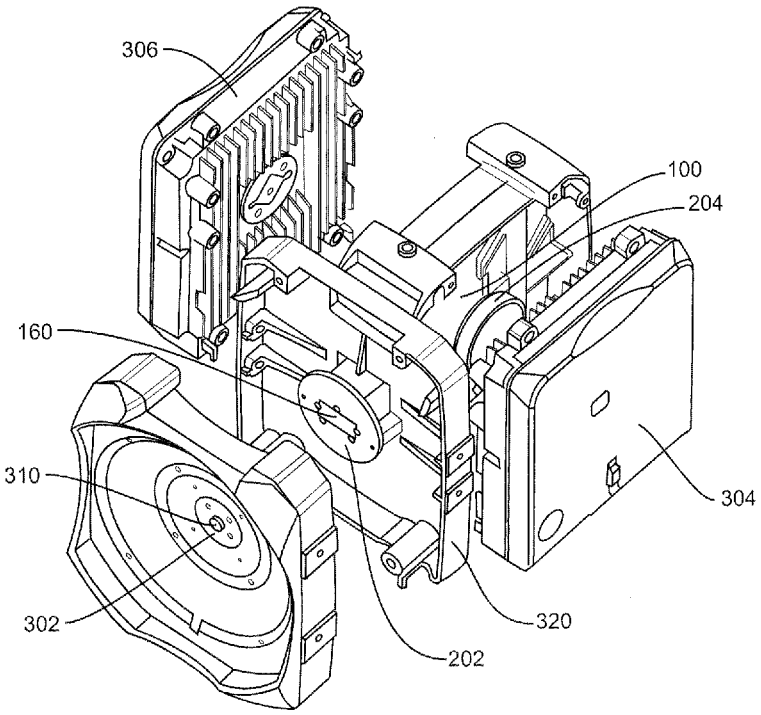
FIG. 3 is an antenna feed device in accordance with one embodiment of the present invention shown partly assembled with radio units and ortho-mode transducer.

With reference to FIG. 1 and FIG. 3 the waveguide interfaces 140, 150, 160 of the antenna feed device 100 are arranged in a T-shape manner. The bottom plane of the 'T' is located in the center of the plane for attaching the antenna to the device 100. It faces directly interface of an OMT which is integrated in the feed support flange of the antenna 302. Thus, the waveguide ports 106, 108 exhibit respective positions and orientations for suitable interfacing the OMT ports. Fitting bolts are used at the faces of both units, i.e. the OMT and the antenna feed device 100 to facilitate the alignment of the waveguides cross sections at this interface during assembling the antenna feed system.

The antenna feed device 100 has independent waveguide runs 102 and 104 from the antenna interface 160 to each of the other two interfaces 140 and 150, which are situated at the right and left side of the 'T'. These locations are in the centre of the left and right sides of the base part 120 of the antenna feed device 100, which allows for direct mounting of a radio equipment at each side. The single waveguide interfaces 140, 150 are also equipped with fitting bolts to achieve the alignment during the mounting of the radio to the antenna feed device 100.

Four stepped, 90-degree waveguide bends 170, 172, 174, 176 are machined from the flange faces and the top plane of the base part 120 of the device 100. This measure allows to avoid any parting plane across the waveguide in the interface flange regions and thus facilitates the later sealing of the complete antenna feed device 100. The respective ports of the bends 170, 172, 174, 176 at the top of base part 120 are interconnected with suitable waveguide structures, which are located in the cover part 130 of the device 100. That is, three walls of the waveguide 102 and 104 are provided by the cover 130 and the mounting plane of the base part 120 completes the hollow waveguide runs. The term mounting plane relates hereinabove to the top plane of the base part to which the cover part is attached when the both parts 120 and 130 are assembled.

Figure 2:
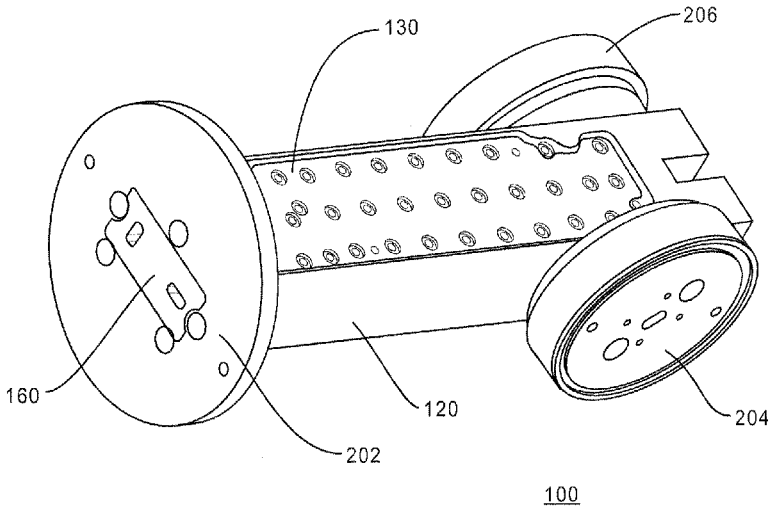
FIG. 2 is an antenna feed device in accordance with one embodiment of the present invention.

Sealing of the device 100 can be realised by placing closed O-rings in groves around the waveguide structures 102 and 104 between the base part 102 and the cover part 130. In alternative embodiments the sealing can be realised with glue or pottant (joint filler) in a suitable way. The device 100 can be directly mounted in the support frame of the antenna feed system. In an alternative mounting solution illustrated in FIG. 2 and FIG. 3 a support flange 202 is assembled between the device 100 and the antenna interface.

In order to facilitate assembling of the whole waveguide system the antenna feed device 100 comprises support flanges 202, 204, 206 at the first, second and third waveguide interfaces 140, 150, 160 for direct interfacing of the radio units 304 and 306 and the antenna. In one embodiment the support flanges 202, 204, 206 are detachably connected to the base part 120.

If one or two of the radio waveguide interfaces do not have an alignment of zero or 90° (e.g. 45°) waveguide twist transformers can be additionally placed between the respective equipment interfaces. In one embodiment the waveguide twists are integrated in the support flanges 204, 206 at the radio ends.

It should be noted, that mechanical interface of the device 100 corresponds to that of a single radio, while the complete interfaces (mechanically and electrically) for the radios conform with the single polarised antenna interface. This yields a high flexibility of the approach, i.e., an operational link with one radio can easily be upgraded for doubling the link capacity by polarisation reuse. The radios will be dismounted from the antennas at the stations and the single polarized feed systems are replaced by the dual-mode ones. Instead of the radio, the mounting/support frame with the antenna feed device 100 is assembled onto the antenna. And finally, the two radios, each serving one polarisation are directly mounted to the device 100.

With reference to FIG. 3 an antenna feed device 100 is shown partly assembled with radio units 304, 306 and ortho-mode transducer integrated in the feed support flange 302. In the embodiment depicted in FIG. 3 a particular OMT design is used that provides the dedicated waveguide interfaces for both polarisations in one plane, which is opposite to the common interface with the circular waveguide. Consequently, the OMT is an integrated part of the feed support flange 302, which is associated with the straight circular waveguide section 310 connecting the integrated feeder, not shown, at the other end. The complete feed system is mounted with the support flange in the antenna vertex. Owing to sealing purposes this OMT design has no parting in the region of the waveguide interfaces.

The antenna feed according to the present invention is preferably manufactured from a block of metal in the process of milling. However it is within the contemplation of the invention that alternative methods of manufacturing can also be used. In principle, the component could be manufactured as diecast also—from aluminium or even from metallized plastic. In case of milling the device exhibits some radii in the corners of the cross sections. However, complete rectangular shapes are also possible—that could be a suitable solution for high quantity production by e.g. diecasting with aluminium or silver-plated plastic.

The invention claimed is:

1. An antenna feed device comprising:

a first waveguide assigned to feed a signal having a first polarization to a dedicated antenna;

a second waveguide separated from the first waveguide, and assigned to feed a signal having a second polarization to the antenna;

each of the first and second waveguides having substantially an overall L-shape in which at least one section of each L-shaped waveguide is parallel to at least one section of the other L-shaped waveguide, and each L-shaped waveguide comprising:

an antenna end terminating in a first plane at one end of the first and second waveguides, and configured to connect the first and second waveguides to an ortho-mode transducer; and a radio end disposed at opposite ends of the first and second waveguides, each radio end terminating at a corresponding single waveguide port disposed on opposing sidewalls of the antenna feed device and configured to connect to respective radio equipment comprising first and second radio units; and the first and second waveguides being formed to connect the antenna and the radio equipment in a substantially compact T-shape interconnection configuration.

2. The antenna feed device of claim 1 wherein the first and the second waveguides comprise a substantially rectangular shape.

3. The antenna feed device of claim 2 further comprising:

a base part and a cover part, the cover part comprising:

three sidewalls forming a part of the first rectangular waveguide;

another three sidewalls forming a part of the second rectangular waveguide; and four 90-degree bends, disposed at the ends of each of the first and second waveguides;

the base part configured to connect to the cover part, and comprising:

a first waveguide interface configured to connect the first radio unit to the first rectangular waveguide;

a second waveguide interface configured to connect the second radio unit to the second rectangular waveguide;

a third waveguide interface configured to connect the first and second rectangular waveguides to said ortho-mode transducer; and four 90-degree bends configured to connect respective ones of said ends of the first and second rectangular waveguides to respective inputs and outputs of the first, second, and third waveguide interfaces, each of the four 90-degree bends in the base being configured to connect to corresponding ones of the 90-degree bends formed in the cover part; and a fourth sidewall for each of the first and second waveguides configured to substantially close the first and second waveguides when the base part is connected to the cover part.

4. The antenna feed device of claim 3 wherein at least one of the 90-degree bends is a stepped band.

5. The antenna feed device of claim 3 wherein the base part and the cover part are configured to seal to each other using at least one of an o-ring, glue, or pottant.

6. The antenna feed device of claim 3 further comprising support flanges disposed at the first, second and third waveguide interfaces, and wherein the support flanges are configured to directly interface the first and second radio units to the antenna.

7. The antenna feed device of claim 6 wherein the support flanges are detachably connected to the base part.

8. The antenna feed device of claim 6 wherein at least one of the support flanges comprises a waveguide twist transformer.

* * * * *